US010017960B2

(12) United States Patent
Kristensen

(10) Patent No.: US 10,017,960 B2
(45) Date of Patent: Jul. 10, 2018

(54) KEY BOX

(71) Applicant: Bekey A/S, Høje Taastrup (DK)

(72) Inventor: Torben Kristensen, Høje Taastrup (DK)

(73) Assignee: Bekey A/S, Høje Taastrup (DK)

( * ) Notice: Subject to any disclaimer, the term of this patent is extended or adjusted under 35 U.S.C. 154(b) by 14 days.

(21) Appl. No.: 15/109,378

(22) PCT Filed: Jan. 9, 2015

(86) PCT No.: PCT/EP2015/050323
§ 371 (c)(1),
(2) Date: Jun. 30, 2016

(87) PCT Pub. No.: WO2015/107006
PCT Pub. Date: Jul. 23, 2015

(65) Prior Publication Data

US 2016/0319568 A1 Nov. 3, 2016

(30) Foreign Application Priority Data

Jan. 14, 2014 (DK) ..... 2014 70014

(51) Int. Cl.
*E05B 19/00* (2006.01)
*G07C 9/00* (2006.01)
(Continued)

(52) U.S. Cl.
CPC ..... *E05B 19/0005* (2013.01); *E05B 47/0001* (2013.01); *E05B 47/0696* (2013.01);
(Continued)

(58) Field of Classification Search
CPC .. E05B 19/0005; E05B 47/00; E05B 47/0001; E05B 2047/0072;
(Continued)

(56) References Cited

U.S. PATENT DOCUMENTS 4,609,780 A * 9/1986 Clark ..... G07C 9/00023 340/5.22
4,727,368 A * 2/1988 Larson ..... G07C 1/32 70/63

(Continued)

FOREIGN PATENT DOCUMENTS

EP 0405061 A1 1/1991
EP 1981003 A2 10/2008

(Continued)

OTHER PUBLICATIONS

International Search Report corresponding to Application No. PCT/EP2015/050323, European Patent Office, dated May 18, 2015; (4 pages).

(Continued)

*Primary Examiner* — Christopher J Boswell
(74) *Attorney, Agent, or Firm* — Nixon Peabody LLP

(57) ABSTRACT

A key box (1) has a housing (10) and a cooperating door (11) which, in combination, form a secured space (9) when the door (11) is closed, wherein the door (11) is locked by means of an electric locking system. The locking system comprises an electric locking mechanism (21), an electronic control unit (22) and a wireless communication unit (23). The electronic control unit (22) is configured to communicate wirelessly with a mobile unit (40) by means of the wireless communication unit (23). The electronic control unit (22) is configured to verify access rights relative to the mobile unit (40) and, if the access rights are authenticated, to cancel the locking effect of the locking mechanism (21). The control unit (22) and the wireless communication unit (23) are accommodated within the secured space (9).

20 Claims, 2 Drawing Sheets

Figure 1:
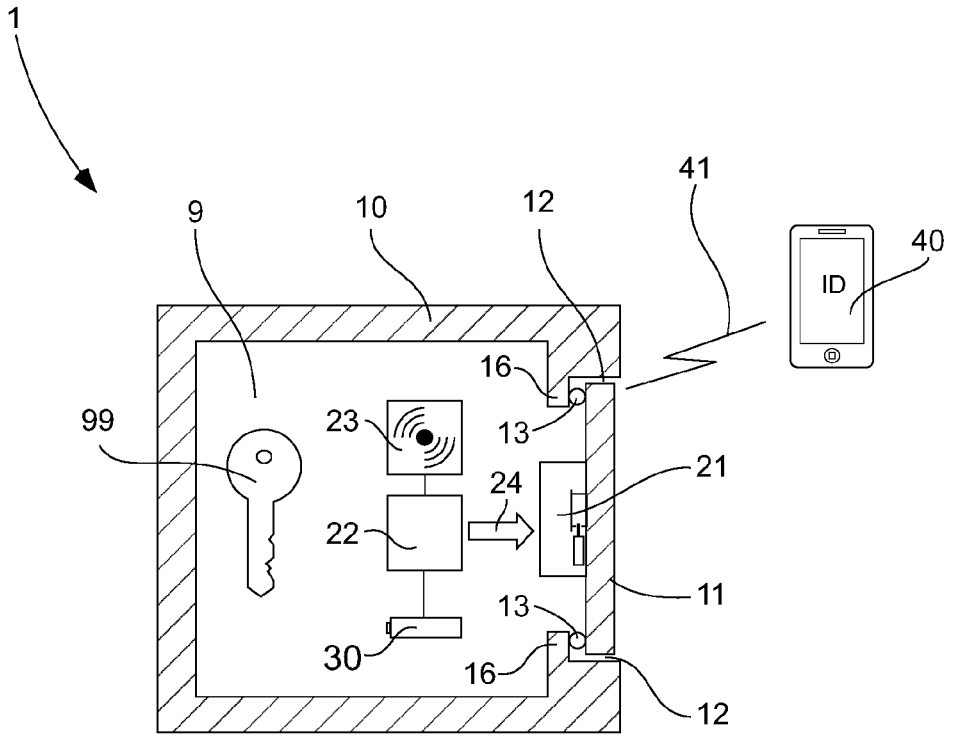

(51) Int. Cl.
*E05B 47/00* (2006.01)
*E05B 67/02* (2006.01)
*E05B 47/06* (2006.01)

(52) U.S. Cl.
CPC ..... *E05B 67/02* (2013.01); *G07C 9/00309* (2013.01); *E05B 2047/0094* (2013.01); *E05B 2047/0095* (2013.01); *G07C 2009/00317* (2013.01); *G07C 2009/00341* (2013.01); *G07C 2009/00642* (2013.01); *G07C 2009/00769* (2013.01); *G07C 2009/00793* (2013.01)

(58) Field of Classification Search
CPC ..... E05B 2047/0073; E05B 2047/0094; E05B 2047/0095; E05B 67/02; G07C 9/00309; G07C 9/00142; G07C 9/00571; G07C 2009/00317; G07C 2009/00325; G07C 2009/00333; G07C 2009/00341; G07C 2009/00349; G07C 2009/00357; G07C 2009/00634; G07C 2009/00642; G07C 2009/00769; G07C 2009/00777; G07C 2009/00785; G07C 2009/00793; G07C 2009/00801
See application file for complete search history.

(56) References Cited

U.S. PATENT DOCUMENTS 4,838,052 A 6/1989 Williams et al.
5,124,696 A * 6/1992 Bosley ..... E05L 347/0002 340/5.65
5,280,518 A * 1/1994 Danler ..... G07C 1/32 340/5.23
5,791,172 A 8/1998 Deighton et al.
7,340,400 B2 * 3/2008 McGinn ..... G06Q 10/087 340/5.8
8,058,971 B2 * 11/2011 Harkins ..... G07C 9/00103 340/5.2
9,194,157 B2 * 11/2015 Bahar ..... E05B 19/0005
9,540,845 B1 * 1/2017 Yang ..... E05B 19/0005
2003/0179075 A1 9/2003 Greenman
2004/0025039 A1 2/2004 Kuenzi et al.
2004/0160304 A1 8/2004 Mosgrove et al.
2007/0227913 A1 * 10/2007 Shoenfeld ..... E05L 347/0012 206/1.5

FOREIGN PATENT DOCUMENTS

EP 1540119 B1 1/2010
WO WO 2006/102895 A1 10/2006
WO WO 2012/139282 A1 10/2012

OTHER PUBLICATIONS

International Written Opinion corresponding to Application No. PCT/EP2015/050323, European Patent Office, dated May 18, 2015; (5 pages).

* cited by examiner

KEY BOX

CROSS-REFERENCE TO RELATED APPLICATIONS

This application is a U.S. National Stage of International Application No. PCT/EP2015/050323, filed Jan. 9, 2015, which claims the benefit of Denmark Patent Application No. PA 2014 70014, filed Jan. 14, 2014, both of which are incorporated herein by reference in their entireties.

The invention relates to a key box with a housing and a cooperating door which, in combination, form a secured space when the door is closed, wherein the door is locked by means of an electric locking system, which locking system comprises an electric locking mechanism, an electronic control unit, and a wireless communication unit, wherein the electronic control unit is configured to communicate wirelessly with a mobile unit by means of the wireless communication unit to verify access rights relative to the mobile unit and, if the access rights are authenticated, to cancel the locking effect of the locking mechanism.

Key boxes for safe keeping of access items, such as keys or access cards, are known. Such key boxes are used e.g. by workmen, service businesses in the care or the cleaning sector, or rescue workers in emergencies, to obtain access to keys/access cards for flats or properties merely by use of one common code or key.

From DK 1 540 119 a device for safe handling of keys is known. The device is a key tube with a case to be mounted in a wall and a lockable element which is displaceable in the case and features a compartment for safe keeping of a key. The key tube comprises an electrically/electronically controlled locking device which, in one embodiment, can be remote-controlled. It is the drawback of that device that the key tube is to be located on/in an element, such as a wall, in such a manner that the locking device is not accessible from an accessible side of the element. This entails cumbersome installation where the locking mechanism and its electric/electronic control is at all times accessible from a non-secured area, e.g. from the rear side of the wall, and is hence not safeguarded against manipulation and/or vandalism in a satisfactory manner.

It is the object of the invention to provide a key box that overcomes at least some of the drawbacks set forth above or provides an alternative by which the key box is readily installed while simultaneously it is safeguarded against break-ins by both mechanical and electronic means.

The invention solves that problem by means of a key box according to claim 1. Advantageous embodiments are recited in the dependent claims referring to claim 1.

According to one embodiment, the key box has a housing and a cooperating door which, in combination, form a secured space when the door is closed, wherein the door is locked by means of an electric locking system, which locking system comprises an electrically operated locking mechanism, an electronic control unit, and a wireless communication unit, wherein the electronic control unit is configured to communicate wirelessly with a mobile unit by means of the wireless communication unit to verify access rights relative to the mobile unit and, if the access rights are authenticated, to cancel the locking effect of the locking mechanism, and wherein the control unit and the wireless communication unit are accommodated within the secured space.

The housing is for fixed mounting on a wall or the like and forms a cavity for receiving items. The housing has an opening that can be closed by means of the door to prevent access to the cavity. The door can be locked in its closed position. The housing and the door thereby form a secured space in which items can be kept safely. The door is mounted on/in the housing and is movable relative thereto between an open position and a closed and lockable position. The term "door" is to be understood in a wide sense and may e.g. be a body which is pivotal or displaceable relative to the housing.

As mentioned, the door can be locked when it is in the closed position. The locking effect is produced by an electrically operated locking mechanism which is controlled by an electronic control unit that is capable of communicating via wireless communication with a mobile unit. The electric locking mechanism typically comprises a movable element where the movement is controlled by means of an electric actuator, and where the actuator is actuated in response to a control signal from the control unit by providing the actuator with current from a current supply circuit which is connected to a power source.

The wireless communication unit is configured for receiving/exchanging access-related information from the mobile unit. The mobile unit can be of any suitable type, such as a mobile phone, a hardware token, a key or card with integral ID-chip or the like. By 'wireless communication' is intended transmission via radio waves, i.e. via electromagnetic waves in the radio frequency range (RF). The wireless communication is preferably local. The wireless communication may preferably be established directly between the mobile unit and the communication unit, where the wireless communication unit uses a standardised technology for wireless communication at short distances, such as Bluetooth, 'Near Field Communication' (NFC), RFID, or the like. The wireless communication is preferably protected e.g. by encryption.

The electronic control unit is configured for controlling the access rights on the basis of the access-related information that the electronic control unit has exchanged with/collected/received from the mobile unit via the wireless communication unit. Typically, the exchange of data between the wireless communication unit and the control unit does not take place wirelessly. If the access rights are authenticated, the control unit emits a signal to the effect that the electric locking mechanism is operated to cancel the locking effect.

By arranging the entire electric locking system, i.e. in addition to the electric locking mechanism also the electronic control unit and the wireless communication unit within the secured space, trespassers are prevented from breaking into the less secured communication and signal paths between those components. Thereby safeguarding against electronic break-in is further enhanced. Moreover, the electronic control unit and the wireless communication unit are safeguarded against vandalism. Additionally, a key box is provided which is easy to mount in a secure manner without major installation measures apart from optionally coupling an external power source thereto.

The key box is built to prevent violent ingress into the secured space when the door is locked to the effect that an access item, such as a key or an access card, can be kept safely therein. The structural strength of the key box is therefore an important boundary condition for obtaining safeguarding against mechanical break-in. The housing and the cooperating door are therefore typically made of a hardened material, typically an appropriately treated metal such as hardened steel which is suitable for resisting attempted break-ins by mechanical means. When the door is closed, the housing and the cooperating door that are made of an electrically conducting material form a Faraday cage around the secured space which entails a powerful attenuation of the wireless signal. In order to enable establishment of a wireless communication between the wireless communication unit which, for safety considerations, is arranged in the interior of the key box and a mobile unit outside the key box, measures need to be taken to transfer the wireless signal between the interior and the exterior of the key box. For instance, openings may be provided in the wall of the housing and/or in the door to convey the wireless signal through the shell of the secured space. Alternatively, it is an option to arrange an antenna outside the secured space, e.g. on the outer side of the door or the housing, and to transmit the signal, wired or not wired, from the interior of the key box to the antenna on the exterior of the key box and from there to establish a wireless communication to the mobile unit. In some cases, such measures may entail a structural weakening of the housing and/or door of the key box, they may be costly in the manufacturing process, the product will generally be more vulnerable to vandalism, and they may entail that particular considerations are to be made, e.g. to an external antenna, when deploying the key box.

According to a preferred embodiment of the key box, the transition between the housing and the door is, in the closed state thereof, configured for transferring a wireless signal between the interior and the exterior of the key box. By conveying the wireless signal through the transition between door and the seating of the door, a structural weakening of the housing and/or the door is avoided.

According to a further embodiment of the key box, the transition comprises means for electrical insulation between the housing and the door. By insulating the door relative to the housing, the attenuating effect of the Faraday cage is weakened, and the conditions for transmitting the wireless signal between the interior and the exterior of the key box are improved.

According to a further embodiment of the key box, the means for electrical insulation are arranged at areas/points/abutment faces with mechanical contact between the housing and the door and/or between the housing and the locking mechanism and/or between the door and the locking mechanism. At areas, points and/or abutment faces with potential mechanical contact between the housing and the door, housing and door may also be coupled electrically. The coupling may be galvanic or electromagnetic/capacitive. By improving the electric separation between door and housing by means of means for electrical insulation, in particular in those points, the attenuating effect of the Faraday cage is weakened, and the conditions for transmission of the wireless signal between the interior and the exterior of the key box are improved.

Ideally the galvanic separation between door and housing needs to be the best one possible. However, the signal transmission taking pace in the radiofrequency range, it is noted that, at a given transmission strength, it is still possible to obtain a sufficient signal strength to establish a reliable wireless communication between the interior and the exterior of the key box, even in case a measurement at direct current (DC) shows an electric connection between door and housing, e.g. via the axis of the hinge.

According to a further embodiment of the key box, the transition is configured to at least partially form a gap between the housing and the door along the peripheral edge of the door. By forming a gap between housing and door, an opening is formed. Moreover, both the capacitive coupling and the option of potential galvanic connections between housing and door are reduced. Thereby the attenuating effect of the Faraday cage is weakened, and the conditions for transfer of the wireless signal between the interior and the exterior of the key box are improved.

According to a further embodiment of the key box, the electrically operated locking mechanism comprises an electric strike plate that cooperates with a spring-loaded latch bolt to produce the locking effect.

The electric strike plate has a movable interlock means. The movement of the interlock means is controlled by means of an electric actuator and a power supply circuit where the actuator is actuated in response to a control signal by providing the actuator with power from the power supply circuit which is coupled to a power source. A projectable latch bolt which is spring-loaded towards a projected position is configured for cooperating with the interlock means of the strike plate to produce a locking effect. The locking effect occurs in a known manner when the latch bolt is projected, and the interlock means is in the secured state, and the locking effect between the projected latch bolt and the interlock means is cancelled when the movement of the interlock means is released. Due to the spring-load of the latch bolt towards the projected position, the door can easily be snapped shut, i.e. the door can be caused to move from its open position to a closed and locked position by the door being pushed inwards towards the housing when the interlock means is in the secured state.

According to an advantageous embodiment the movement of the interlock means is released when the actuator is actuated. That embodiment is advantageous due to it usually having the lowest power consumption, the actuator consuming power only to cancel the locking effect, whereas the actuator does not consume power to maintain the locking effect ("currentlessly closed").

The electric strike plate with movable interlock means may advantageously be an off-the-shelf item wherein the electric strike plate is provided with an actuator of known type such as e.g. a solenoid operated with a supply voltage of between five and 24 V, typically about 12 V or about 24 V, and may either be AC or DC. By constructing the key box such that it is possible to use commercially available components, the development and production costs can be reduced.

According to a further embodiment of the key box, the electric strike plate is arranged on the housing, and the spring-loaded latch bolt is arranged on the door.

According to a particularly preferred embodiment of the key box, the door is, in its closed state, spring-loaded in the opening direction, and the electric locking mechanism is configured to cancel the locking effect only in unloaded state, i.e. one is, at a minimum, to equalize the force of the spring loading to cancel the locking effect. Thereby a push-push functionality is accomplished that requires an active gesture from an individual to cancel the locking effect and open the door: the door must be pushed inwards towards the housing to remove the load from the electric locking mechanism, following which it cancels the locking effect, and the door swings open by means of the spring load in the opening direction. That embodiment prevents unlocking of the key box in case the electric strike plate is unintentionally actuated.

At the same time there is no need for a handle or a grip on the outside of the door to enable opening thereof. Thereby a plane surface is obtained with fewer points of attack for mechanical break-in. When the locking effect of the electric striker plate has been re-established, the door can be closed and locked again. The electric locking mechanism is advantageously configured for the door to be able to engage with the housing by snapping effect merely by the door being influenced in the direction inwards towards the housing.

According to an alternative embodiment, the electric locking system can be supplemented with a mechanism which, per se, keeps the door closed in unlocked state and thereby requires an active gesture from an individual to open the door after cancellation of the locking effect of the electric locking system. Such embodiments prevent that the door of the key box opens or swings open on its own account and is left open in case the electric strike plate is actuated unintentionally. Suitable mechanisms which require an active gesture from an individual to open the door may comprise magnets, spring-loaded snap elements, spring loading of the door in closing direction or the like.

By a further advantageous embodiment of the key box the door is hinged pivotally.

According to a further embodiment of the key box, the electrically operated locking mechanism is powered by a power source that comprises one or more batteries. Thereby a key box is obtained that is easy to mount since it does not require any external power source. Alternatively, an external power source may be combined with a battery supply such as an emergency power supply in case of power failure.

According to a further embodiment of the key box, the power source is arranged within the secured space. Thereby a key box is accomplished which is independent of an external power supply and which is further safeguarded against unauthorized and undesired influences.

According to a particular, power-saving embodiment the power supply circuit for powering an actuator in the electric strike plate may be configured for providing a time-dependent voltage course with a first voltage level to change the state of the actuator from deactivated to activated, followed by a second voltage level which is lower than the first voltage level to maintain the activated state of the actuator. That embodiment is particularly advantageous in connection with battery operation. The time-dependent voltage course may advantageously be provided as described in further detail in the co-pending Danish patent application PA 2013 70608 relating to an electric strike-plate system.

Figure 2:
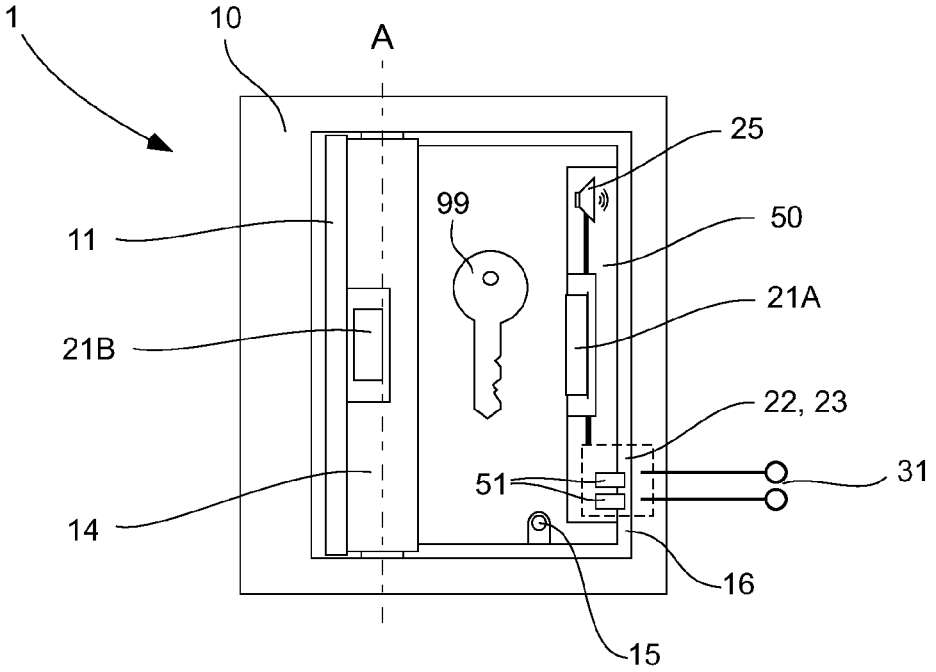
Figure 3:
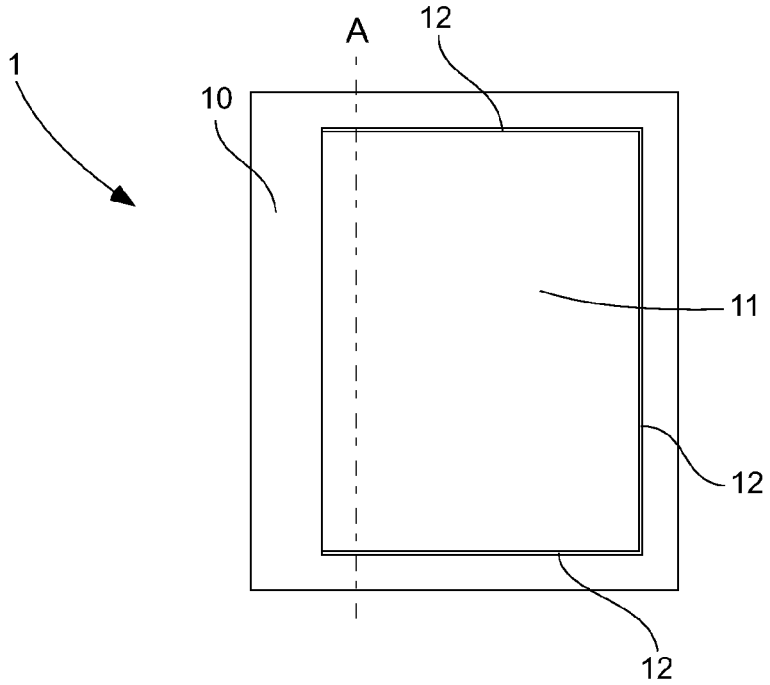

In the following, the invention will be described in further detail with reference to an advantageous embodiment as shown in the drawing, wherein corresponding reference numerals refer to corresponding elements. In the drawing:

FIG. 1 shows a diagram of the key box according to an embodiment of the invention;

FIG. 2 schematically shows a key box according to an embodiment of the invention, seen from in front with open door; and FIG. 3 schematically shows the key box shown in FIG. 2, seen from in front with closed door.

FIG. 1 shows a diagram of the key box 1 in wireless communication with a mobile unit 40, such as a mobile phone. The key box 1 has a housing 10 which, in combination with a door 11 in its closed state, forms a secure space 9 in which access items 99 can be kept, such as keys and access cards.

The key box 1 is provided with an electric locking system that comprises an electrically actuatable locking mechanism 21, an electronic control unit 22, and a communication unit 23 for wireless communication e.g. via Bluetooth. The electric locking system is powered by a power source, in the shown example a battery supply 30. The electric locking system and the battery supply are arranged inside the secure space 9 of the key box and are hence safeguarded against manipulation. The electric locking system can be unlocked from the outside by means of a mobile unit 40 that has associated access rights. By means of the communication unit 23, a wireless connection is established, via a wireless signal 41, between the mobile unit 40 and the electric locking system, and items of access information are exchanged. The wireless connection may be e.g. a Bluetooth connection. Based on the exchanged items of access information, the control unit 22 verifies the access rights relative to the mobile unit 40. If the access rights for the mobile unit 40 are authenticated, the control unit 22 transmits a control signal 24 and actuates the electric locking mechanism 21 to cancel the locking effect. When the locking effect is cancelled, the door 11 can be opened, and the interior of the key box 1 becomes available to a user who wishes to deposit or collect an access item 99.

The housing 10 and the door 11 are typically made of hardened steel and therefore form a Faraday cage around the communication unit 23. The Faraday cage may bring about a marked attenuation of the wireless radio signal 41 and hence prevent establishment of a wireless connection between the communication unit 23 and the mobile unit 40. The door 11 is consequently suspended in such a manner that there is a small distance in the transition 12 between the housing 10 and the door 11 along the round-going edge of the door 11. Thereby a small gap is formed in the transition 12 between the housing 10 and the door 11 through which the wireless signal 41 can be transmitted between the interior and the exterior of the key box 1.

Preferably the housing 10 is, along the edge of the door opening, also provided with a rabbet 16 which, seen from the outside, sits behind the door 11 to prevent easy breaking open of the door by application of mechanical force from the outside in an inwardly oriented direction. In a direction in parallel with the plane of the door, the gap may be e.g. 1 mm, while the gap in a direction at right angles to the plane of the door, i.e. between the rear side of the door and the front side of the rabbet of the door opening, may be between about 1 mm and 3 mm. Thereby the attenuating effect of the Faraday cage is weakened sufficiently to obtain reliable wireless communication while simultaneously the mechanical security of the key box is not compromised. The gap may be proofed e.g. against the ingress of dust or humidity by means of a non-electrically conducting sealant, such as an elastic gasket of rubber or polyester foam.

FIGS. 2 and 3 schematically show a key box 1 from in front and in an open and a closed state, respectively. The key box 1 has a housing 10 and a door 11 with a hinge 14. Inside the key box 1, access items 99 can be accommodated. The door 11 is pivotal about the axis of rotation A of the hinge 14 for opening of the door 11 in an outwardly oriented direction. The key box 1 is provided with an electric strike plate 21A mounted in the housing 10 by means of a fitting 50. The electric strike plate 21A cooperates with a spring-loaded latch bolt 21B mounted on the inner side of the door 11 to produce a locking effect when the door 11 is closed. In its closed state, the door 11 is spring-loaded in the outwardly oriented direction by means of spring element 15. The electric strike plate 21A is of the type that allows cancellation of the locking effect in unloaded state only. Thus, to bring about opening of the door 11, it is to be pressed inwards while simultaneously the electric strike plate 21A receives signal to cancel the locking effect.

The electric strike plate 21A is controlled from an electronic control unit 22 mounted in the housing 10 behind the fitting 50 on the basis of items of access information as described above. A sound emitter 25 may be coupled to the control unit to indicate, by sound signals, one or more different states to a user, such as that the electric locking mechanism of the key box has been (correctly) actuated or that a request for access is to be denied. The items of access information are exchanged via a wireless connection to a mobile unit 40 outside the key box 1 (see FIG. 1). The wireless connection is established by means of a communication unit 23 which is also mounted in the housing 10 behind the fitting 50. When the door 11 is closed, the wireless signal 41 is conveyed through the transition 12 between the housing 10 and the door 11 (see FIG. 1). In the transition 12 there is a gap along the round-going edge of the door 11 as described above. In the area where the wireless communication unit 23 is mounted, the fitting 50 is provided with openings 51 that reach into the rabbet 16 and hence into the transition 12. Those openings improve the coupling of the wireless signal between the communication unit 23 and the transition 12. To further improve the conditions for transfer of the wireless signal through the transition 12, points/areas with potential mechanical contact between the housing 10 and the door 11 may advantageously be insulated galvanically. Those points/areas comprise mechanical contact between spring element 15, the rear side of the door 11, abutment faces between the electric strike plate 21A and the spring-loaded latch bolt 21B or their mounting in the housing 10 and on the door 11, the hinge 14, and the rabbet 16, respectively.

As shown in FIG. 1, the electric locking system comprising an electric locking mechanism 21, 21A/B, an electronic control unit 22, and a communication unit 23 may be powered by a battery 30. Alternatively or in supplement thereto, the electric locking system may also be powered by an external power source 31 as shown in FIG. 2. The external power supply may be conducted through e.g. a cable lead-in (not shown) on the rear side of the housing 10 of the key box 1. The key box 1 may be mounted e.g. on (or in) an element, such as a wall, by means of screws/bolts (not shown) through the rear wall of the housing 10.

The invention claimed is:

1. A key box with a housing and a cooperating door which, in combination, form a secured space when the door is closed, wherein the door is locked by means of an electric locking system, which locking system comprises an electric locking mechanism, an electronic control unit and a wireless communication unit, wherein the electronic control unit is configured to communicate wirelessly with a mobile unit by means of the wireless communication unit to verify access rights relative to the mobile unit and, if the access rights are authenticated, to cancel the locking effect of the locking mechanism, wherein wireless communication is in the radiofrequency (RF) range, wherein the housing and the cooperating door are made of an electrically conducting material, wherein the control unit and the wireless communication unit are accommodated within the secured space, and wherein a transition between the housing and the door, in a closed state thereof, is configured for transferring a wireless signal between the interior and the exterior of the key box, the transition including means for electrical insulation between the housing and the door.

2. A key box according to claim 1, characterised in that the means for electrical insulation are arranged at areas/points/abutment faces with mechanical contact between the housing and the door and/or between the housing and the locking mechanism and/or between the door and the locking mechanism.

3. A key box according to claim 2, characterised in that the electric locking mechanism comprises an electric strike plate that cooperates with a spring-loaded latch bolt to produce the locking effect.

4. A key box according to claim 2, characterised in that the door is, in its closed state, spring-loaded in the opening direction, and the electric locking mechanism is configured to cancel the locking effect only in unloaded state.

5. A key box according to claim 1, characterised in that the transition is configured to at least partially form a gap between the housing and the door along the peripheral edge of the door.

6. A key box according to claim 5, characterised in that the door is, in its closed state, spring-loaded in the opening direction, and the electric locking mechanism is configured to cancel the locking effect only in unloaded state.

7. A key box according to claim 1, characterised in that the electric locking mechanism comprises an electric strike plate that cooperates with a spring-loaded latch bolt to produce the locking effect.

8. A key box according to claim 7, characterised in that the electric strike plate is arranged on the housing, and the spring-loaded latch bolt is arranged on the door.

9. A key box according to claim 8, characterised in that the door is, in its closed state, spring-loaded in the opening direction, and the electric locking mechanism is configured to cancel the locking effect only in unloaded state.

10. A key box according to claim 7, characterised in that the door is, in its closed state, spring-loaded in the opening direction, and the electric locking mechanism is configured to cancel the locking effect only in unloaded state.

11. A key box according to claim 1, characterised in that the door is, in its closed state, spring-loaded in the opening direction, and the electric locking mechanism is configured to cancel the locking effect only in unloaded state.

12. A key box according to claim 1, characterised in that the electric locking mechanism is powered by a power source that comprises one or more batteries.

13. A key box according to claim 12, characterised in that the power source is arranged within the secured space.

14. A key box according to claim 1, characterised in that the electric locking mechanism comprises an electric strike plate that cooperates with a spring-loaded latch bolt to produce the locking effect.

15. A key box according to claim 1, characterised in that the electric locking mechanism comprises an electric strike plate that cooperates with a spring-loaded latch bolt to produce the locking effect.

16. A key box according to claim 1, characterised in that the door is, in its closed state, spring-loaded in the opening direction, and the electric locking mechanism is configured to cancel the locking effect only in unloaded state.

17. A key box according to claim 1, characterised in that the door is, in its closed state, spring-loaded in the opening direction, and the electric locking mechanism is configured to cancel the locking effect only in unloaded state.

18. A key box according to claim 1, characterised in that the transition is configured to at least partially form a gap between the housing and the door along the peripheral edge of the door.

19. A key box according to claim 1, wherein the housing is composed of a hardened material suitable for resisting break-ins into the key box by mechanical means or violent ingress into the secured space when the door is locked.

20. A key box with a housing and a cooperating door which, in combination, form a secured space when the door is closed, wherein the door is locked by means of an electric locking system, which locking system comprises an electric locking mechanism, an electronic control unit and a wireless communication unit, wherein the electronic control unit is configured to communicate wirelessly with a mobile unit by means of the wireless communication unit to verify access rights relative to the mobile unit and, if the access rights are authenticated, to cancel the locking effect of the locking mechanism, wherein wireless communication is in the radiofrequency (RF) range, wherein the housing and the cooperating door are made of an electrically conducting material, wherein the control unit and the wireless communication unit are accommodated within the secured space, and wherein a transition between the housing and the door, in a closed state thereof, is configured for transferring a wireless signal between the interior and the exterior of the key box, the transition being configured to at least partially form a gap between the housing and the door along the peripheral edge of the door.

* * * * *